US010946692B2

(12) United States Patent
Moriya et al.

(10) Patent No.: US 10,946,692 B2
(45) Date of Patent: Mar. 16, 2021

(54) METHOD AND APPARATUS FOR MANUFACTURING PRINTING PAPER FOR DECORATIVE BOARDS AND METHOD FOR MANUFACTURING LAMINATED STRUCTURE

(71) Applicants: Yoshihiro Moriya, Shizuoka (JP); Shizuka Kohzuki, Kanagawa (JP)

(72) Inventors: Yoshihiro Moriya, Shizuoka (JP); Tatsuya Morita, Tokyo (JP); Shizuka Kohzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 16/125,249

(22) Filed: Sep. 7, 2018

(65) Prior Publication Data

US 2019/0077186 A1 Mar. 14, 2019

(30) Foreign Application Priority Data

Sep. 8, 2017 (JP) ..... JP2017-173417

(51) Int. Cl.

| | |
|---|---|
| ***B44C 5/04*** | (2006.01) |
| ***B41M 5/52*** | (2006.01) |
| ***D21H 27/26*** | (2006.01) |
| ***B27D 1/00*** | (2006.01) |
| ***B41M 5/50*** | (2006.01) |
| ***D21H 25/04*** | (2006.01) |
| ***D21H 17/48*** | (2006.01) |

(Continued)

(52) U.S. Cl.

CPC ..... *B44C 5/0469* (2013.01); *B27D 1/00* (2013.01); *B41M 5/502* (2013.01); *B41M 5/5218* (2013.01); *D21H 17/48* (2013.01); *D21H 17/49* (2013.01); *D21H 17/51* (2013.01); *D21H 25/04* (2013.01); *D21H 27/26* (2013.01)

(58) Field of Classification Search

None

See application file for complete search history.

(56) References Cited

U.S. PATENT DOCUMENTS

2002/0146545 A1 10/2002 Franzoi et al.
2010/0075045 A1* 3/2010 Kaimoto ..... B41M 5/502 427/256

(Continued)

FOREIGN PATENT DOCUMENTS

AP 2010-214831 9/2010
EP 2 412 537 A1 2/2012

(Continued)

OTHER PUBLICATIONS

Extended European Search Report dated Feb. 18, 2019 in European Patent Application No. 18187591.5, 8 pages.

*Primary Examiner* — Shamim Ahmed
*Assistant Examiner* — Bradford M Gates
(74) *Attorney, Agent, or Firm* — Oblon, McClelland, Maier & Neustadt, L.L.P.

(57) ABSTRACT

A method for manufacturing a printing paper for decorative boards is provided. The method includes the processes of: applying a resin-containing liquid comprising at least one of a resin and a resin precursor to a base paper for decorative boards; forming a print layer on or in the base paper which is not dried after the resin-containing liquid is applied thereto; and solidifying a liquid contained in the base paper having the print layer.

12 Claims, 1 Drawing Sheet

(51) Int. Cl.
*D21H 17/49* (2006.01)
*D21H 17/51* (2006.01)

(56) References Cited

U.S. PATENT DOCUMENTS

| | | | | |
|---|---|---|---|---|
| 2012/0001981 | A1 | 1/2012 | Ohshima et al. | |
| 2012/0026264 | A1 | 2/2012 | Ikoshi | |
| 2013/0078437 | A1 | 3/2013 | Symkens et al. | |
| 2015/0010722 | A1* | 1/2015 | Yamada ..... | C09D 11/36<br>428/35.7 |
| 2016/0208121 | A1 | 7/2016 | De Mondt et al. | |
| 2016/0325558 | A1 | 11/2016 | Strijckers | |
| 2017/0058456 | A1 | 3/2017 | Loccufier et al. | |
| 2017/0342287 | A1 | 11/2017 | De Mondt et al. | |
| 2018/0093494 | A1 | 4/2018 | Strijckers | |

FOREIGN PATENT DOCUMENTS

| | | | |
|---|---|---|---|
| EP | 2 574 476 | A1 | 4/2013 |
| EP | 2 865 531 | A1 | 4/2015 |
| EP | 2 894 044 | A1 | 7/2015 |
| EP | 2 905 376 | A1 | 8/2015 |
| EP | 3 034 572 | A1 | 6/2016 |
| JP | 63-084935 | | 4/1988 |
| JP | 2005-001146 | | 1/2005 |
| JP | 2015-086373 | | 5/2015 |
| WO | WO2014/084280 | A1 | 6/2014 |
| WO | WO2017/090222 | A1 | 6/2017 |

* cited by examiner

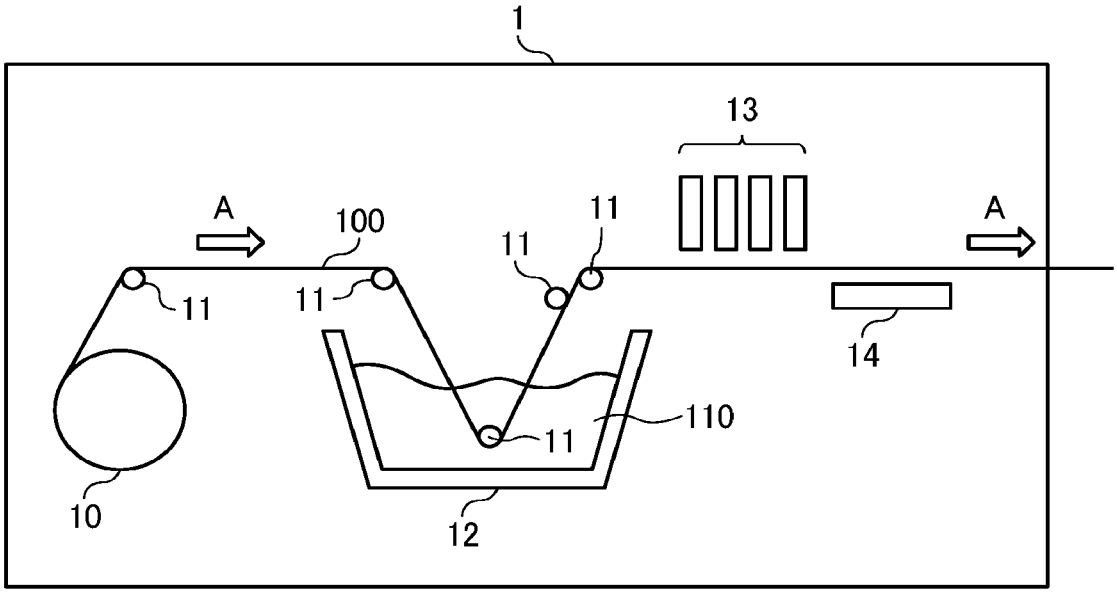
1
13
A
100
11
11
A
11
11
14
110
11
10
12

METHOD AND APPARATUS FOR MANUFACTURING PRINTING PAPER FOR DECORATIVE BOARDS AND METHOD FOR MANUFACTURING LAMINATED STRUCTURE

CROSS-REFERENCE TO RELATED APPLICATIONS

This patent application is based on and claims priority pursuant to 35 U.S.C. § 119(a) to Japanese Patent Application No. 2017-173417, filed on Sep. 8, 2017, in the Japan Patent Office, the entire disclosure of which is hereby incorporated by reference herein.

BACKGROUND

Technical Field

The present disclosure relates to a method for manufacturing a printing paper for decorative boards, an apparatus for manufacturing a printing paper for decorative boards, and a method for manufacturing a laminated structure.

Description of the Related Art

Low-pressure melamine decorative boards and high-pressure melamine decorative boards are known as decorative boards used for wall materials and floor materials. The low-pressure melamine decorative board may be obtained by laminating a base paper for decorative boards ("decorative board base paper") impregnated with a melamine resin and a substrate such as a medium-density fiberboard (MDF), and applying heat and pressure to adhere the layers through the melamine resin. The high-pressure melamine decorative board may be obtained by laminating a decorative board base paper impregnated with a melamine resin and a core base paper impregnated with a phenolic resin, then applying heat and pressure to obtain a molded body, and adhering the molded body to a substrate with an adhesive. It is known that the decorative board base paper is adjusted in design by a method such as gravure printing, flexographic printing, and offset printing. In addition to the above-described printing methods, a technique for enabling a small amount of printing by an inkjet printing method without using a plate is also known.

SUMMARY

In accordance with some embodiments of the present invention, a method for manufacturing a printing paper for decorative boards is provided. The method includes the processes of: applying a resin-containing liquid comprising at least one of a resin and a resin precursor to a base paper for decorative boards; forming a print layer on or in the base paper which is not dried after the resin-containing liquid is applied thereto; and solidifying a liquid contained in the base paper having the print layer.

In accordance with some embodiments of the present invention, an apparatus for manufacturing a printing paper for decorative boards is provided. The apparatus includes an applying device, a printing device, and a solidifying device. The applying device is configured to apply a resin-containing liquid comprising at least one of a resin and a resin precursor to a base paper for decorative boards. The printing device is configured to form a print layer on or in the base paper to which the resin-containing liquid is applied. The solidifying device is configured to solidify a liquid contained in the base paper having the print layer. In the applying device, no dryer is disposed on a conveyance path between the applying device and the printing device.

In accordance with some embodiments of the present invention, a method for manufacturing a laminated structure. The method includes the processes of: applying a resin-containing liquid comprising at least one of a resin and a resin precursor to a medium; forming a print layer on or in the base paper which is not dried after the resin-containing liquid is applied thereto; solidifying a liquid contained in the medium having the print layer to form a print medium; and applying heat and pressure to a laminate in which the print medium and a substrate are laminated.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawing, which is intended to depict example embodiments of the present invention and should not be interpreted to limit the scope thereof. The accompanying drawing is not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

When a print layer is formed on or in a medium such as a decorative board base paper by an inkjet method, the ink is required to have discharge stability over an extended period of time. Since the viscosity and solid content of the ink to be discharged are limited, there may be a problem that the image density is lower than expected as a decorative board as a laminated structure. Further, in the case of increasing image density by increasing the adhesion amount of the ink, nonvolatile components (e.g., a resin) in the ink fill voids in the medium (e.g., a decorative board base paper). As a result, a problem may arise in the subsequent process that impregnation of a melamine resin or the like in the medium is insufficient and that the adhesiveness between the layers constituting the decorative board as a laminated structure is inferior. Furthermore, in the case of providing a primer layer on the surface of a medium such as decorative board base paper, new additional processes such as a primer layer coating process and a drying process are required, resulting in poor manufacturing efficiency.

In accordance with an embodiment of the present invention, a method for manufacturing a print medium, such as a printing paper of decorative boards, is provided. The method provides a laminated structure, such as a decorative board, having excellent image density and adhesiveness at an excellent manufacturing efficiency without any additional process.

Hereinafter, embodiments of the present invention are described.

Method for Manufacturing Print Medium such as Printing Paper for Decorative Boards A method for manufacturing a print medium, such as a printing paper for decorative boards, according to an embodiment of the present invention includes the processes of: applying a resin-containing liquid comprising at least one of a resin and a resin precursor to a base paper for decorative boards; forming a print layer on or in the base paper which is not dried after the resin-containing liquid is applied thereto; and solidifying a liquid contained in the base paper having the print layer. Hereinafter, a method for manufacturing a printing paper for decorative boards is described as an example.

Process of Applying Resin-Containing Liquid to Decorative Board Base Paper

The method for manufacturing a printing paper for decorative boards according to an embodiment of the present invention includes a process of applying a resin-containing liquid containing at least one of a resin and a resin precursor to a base paper for decorative boards (hereinafter "decorative board base paper"). The method of applying the resin-containing liquid may be, for example, immersing the decorative board base paper in the resin-containing liquid or spray-coating the decorative board base paper with the resin-containing liquid. Immersing the decorative board base paper in the resin-containing liquid is more preferable. The immersion enables uniform application of the resin-containing liquid to the decorative board base paper, and the interaction between the components in the resin-containing liquid (to be described later) and the components in the ink is improved. The immersion further enables sufficient permeation of the decorative board base paper with the resin-containing liquid. Thus, it is possible to obtain a decorative board base paper having a strength suitable for decorative board use.

Decorative Board Base Paper

The decorative board base paper has a structure capable of holding the resin-containing liquid. Examples of the decorative board base paper include, but are not limited to, a fibrous structural object and a porous structural object, each of which is capable of holding the resin-containing liquid inside. More specifically, general decorative board base papers used in conventional processes such as gravure printing, flexographic printing, and offset printing may be used. As is well known, the decorative board base paper is a paper stock that contains pulp, synthetic fiber, or the like, and optionally contains additives such as titanium oxide, talc, clay, kaolin, calcium carbonate, colored coloring agent, wet paper strengthening agent, coagulant, and pH adjuster. Preferably, such a decorative board base paper is made into paper by a paper machine such as a Fourdrinier paper machine. The ash content in the decorative board base paper is preferably in the range of from 20% to 40% by mass. The basis weight of the decorative board base paper is not particularly limited, but is preferably in the range of from 50 to 150 g/m$^2$ or less. As long as the decorative board base paper is capable of holding the resin-containing liquid as described above, a film having a fibrous structure or a porous structure may be used.

Resin-Containing Liquid

The resin-containing liquid contains at least one of a resin and a resin precursor, and may contain other components as necessary. In the present disclosure, a "resin-containing liquid" includes not only that including a resin but also that including a resin precursor but no resin. Further, in the present disclosure, a "resin precursor" refers to a component that becomes a resin through a polymerization reaction. Examples thereof include, but are not limited to, monomers, oligomers (including dimer and trimer), and prepolymers. Examples of the resin precursor include, but are not limited to, a melamine resin precursor comprising a composition of a melamine compound represented by the following general formula (I) and an aldehyde compound having an aldehyde group (—CHO) such as formaldehyde.

General Formula (1)

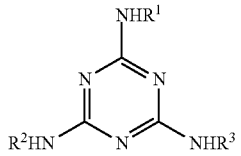

In the general formula (1), $R^1$, $R^2$ and $R^3$ each independently represent a hydrogen atom or a hydrocarbon group having 1 to 4 carbon atoms which may have a substituent.

Preferably, $R^1$, $R^2$ and $R^3$ are all hydrogen atoms.

Preferably, the resin and the resin precursor are a water-based resin and a water-based resin precursor, respectively. The "water-based" here refers to a condition in which the resin or the resin precursor is dissolved, dispersed, or suspended in water. Examples of the resin include, but are not limited to, thermosetting resins such as amino resin, unsaturated polyester resin, diallyl phthalate resin, phenol resin, urea resin, and epoxy resin, and water-soluble resins such as polyvinyl alcohol, cellulose derivative, and polyvinyl pyrrolidone. Examples of the resin precursor include, but are not limited to, precursors of thermosetting resins such as amino resin, unsaturated polyester resin, diallyl phthalate resin, phenol resin, urea resin, and epoxy resin, and precursors of water-soluble resins such as polyvinyl alcohol, cellulose derivative, and polyvinyl pyrrolidone. Each of these resins and resin precursors can be used alone or in combination with others.

Preferably, in the process of producing a decorative board by applying heat and pressure (to be described later), the resin and the resin precursor each may have a role of adhering a decorative board base paper to a member (such as a substrate and an overcoat, to be described later) provided adjacent to the decorative board base paper. Therefore, preferred examples of the resin and the resin precursor include those having cross-linkability. More specifically, an amino resin precursor is preferred and a melamine resin precursor is more preferred. In the present disclosure, the cross-linkability refers to an ability of cross-linking by itself, or an ability of cross-linking in the presence of a cross-linker even without an ability of cross-linking by itself. Preferably, the resin and the resin precursor each have an ability of cross-linking by itself.

The resin-containing liquid contains a solvent or a dispersion medium. The solvent refers to a liquid solvent that dissolves at least one of the resin and the resin precursor contained in the resin-containing liquid. The dispersion medium refers to a liquid dispersion medium that disperses at least one of the resin and the resin precursor contained in the resin-containing liquid. Examples of the solvent and the dispersion medium include, but are not limited to, organic solvents (e.g., alcohol solvents and ketone solvents) and water, and water is preferable.

The content of the resin or the resin precursor in the resin-containing liquid is not particularly limited and may be appropriately selected according to the purpose, but is preferably in the range of from 5.0% to 60.0% by mass. The content of the solvent or the dispersion medium in the resin-containing liquid is not particularly limited and may be appropriately selected according to the purpose, but is preferably in the range of from 30.0% to 98.0% by mass.

Process of Forming Print Layer

According to an embodiment of the present invention, the method for manufacturing a printing paper for decorative boards (hereinafter "decorative board printing paper") has a process of forming a print layer on or in the decorative board base paper which is not dried after the resin-containing liquid is applied thereto. That is, at the time of forming a print layer, the decorative board base paper is wet with the resin-containing liquid. In related art, a process of drying the decorative board base paper by heating or the like is generally conducted after the process of applying the resin-containing liquid to the decorative board base paper and before the process of forming a print layer. On the other hand, in the present disclosure, such a drying process is not conducted. Thus, the process of drying is omitted and the production efficiency can be improved without any additional process. Here, "the decorative board base paper which is not dried after the resin-containing liquid is applied thereto" refers to the decorative board base paper which is not subjected to a process conducted by a dryer after the resin-containing liquid is applied thereto and before a print layer is formed thereon or therein. Examples of the dryer include, but are not limited to, known devices such as a heat blower heating with warm air, an infrared dryer using an infrared lamp, a heated roll passing over a drying target, and an induction heater utilizing induction heating. Even in the case that the process using the dryer is not conducted, the time from the end of the process of applying the resin-containing liquid to the decorative board base paper to the start of the process of forming the print layer is preferably 30 minutes or less. Further, the rate of mass change X of the resin-containing liquid represented by the following formula (1) is preferably 0.7 or more. The mass in the following formula (1) represents the mass per unit area of the decorative board base paper.

$$X=\{(\text{Mass of Decorative Board Base Paper immediately before Printing Layer is formed})-(\text{Mass of Decorative Board Base Paper immediately before being applied with Resin-containing Liquid})\}/\{(\text{Mass of Decorative Board Base Paper immediately after being applied with Resin-containing Liquid})-(\text{Mass of Decorative Board Base Paper immediately before being applied with Resin-containing Liquid})\} \quad \text{Formula (1)}$$

The print layer is provided on or in the decorative board base paper, and contains components used to form the printing layer such as a colorant, water and alcohol solvent.

Examples of the colorant include pigments and dyes. In particular, for good color developing property even after the decorative board base paper has undergone the subsequent process of applying and heat and pressure, known inorganic pigments and organic pigments are preferable. Examples of the inorganic pigments include, but are not limited to, carbon black produced by a furnace method or a channel method, alkaline-earth metal sulfates such as barium sulfate, alkaline-earth metal carbonates such as carbon black carbonate, fine powder silicic acid, silicas such as synthetic silicate, calcium silicate, alumina, alumina hydrate, titanium oxide, zinc oxide, talc, and clay. Examples of the organic pigments include, but are not limited to, azo pigments, phthalocyanine pigments, quinacridone pigments, perylene pigments, nitroso pigments, nitro pigments, isoindolinone organic pigments, pyranthrone organic pigments, thioindigo organic pigments, benzimidazolone organic pigments, quinophthalone pigments, isoindoline pigments, vat-dye pigments, mordant-dye pigments, basic-dye pigments, acidic-dye pigments, and natural-dye pigments. Since the decorative board base paper is wet with the resin-containing liquid due to the absence of drying process at the time the colorant is applied thereto, the colorant more spreads over the surface of the decorative board base paper compared to a case in which the decorative board base paper is dried. Thus, the resulting decorative board printing paper and decorative board each have a print layer having a high image density.

The print layer may be formed by applying an ink containing the colorant to the decorative board base paper by a known method such as a gravure method, a flexo method, an offset method, and an inkjet method. Since the decorative board base paper is wet with the resin-containing liquid without being dried, the print layer is preferably formed by an inkjet method that is a non-contact printing method.

Formation of Print Layer by Inkjet Method

In a case in which the print layer is formed with an ink discharged by an inkjet method, the ink contains the above-described colorant and optionally contains an organic solvent, water, an additive, and the like.

Organic Solvent

The organic solvent is not particularly limited, but preferably has a functional group reactive with at least one of the resin and the resin precursor contained in the resin-containing liquid. The reactivity here refers to an ability of forming a covalent bond between the organic solvent and at least one of the resin and the resin precursor contained in the resin-containing liquid. Such an organic solvent can be solidified in the decorative board base paper in the process of solidifying a liquid contained in the decorative board base paper (to be described later). In a case in which a precursor of an amino resin, such as melamine resin, guanamine resin, and benzoguanamine resin, is contained in the resin-containing liquid, preferred examples of the organic solvent include organic solvents having a hydroxyl group as a functional group, but are not limited thereto. Specific examples of the organic solvents having a hydroxyl group as a functional group include, but are not limited to, alcohol solvents. Specific examples of the alcohol solvents include, but are not limited to: straight-chain alcohols such as lauryl alcohol, cetyl alcohol, stearyl alcohol, behenyl alcohol, myristyl alcohol, oleyl alcohol, and cetostearyl alcohol; higher alcohols such as branched-chain alcohols such as monostearyl glycerin ether (batyl alcohol), 2-decyltetradecinol, lanolin alcohol, cholesterol, phytosterol, hexyldodecanol, isostearyl alcohol, and octyldodecanol; divalent alcohols such as ethylene glycol, propylene glycol, trimethylene glycol, 1,2-butylene glycol, 1,3-butylene glycol, tetramethylene glycol, 2,3-butylene glycol, pentamethylene glycol, 2-butene-1,4-diol, hexylene glycol, octylene glycol, and 1,3-butanediol; trivalent alcohols such as glycerin, trimethylolpropane, and 1,2,6-hexanetriol; tetravalent alcohols such as pentaerythritol; pentavalent alcohols such as xylitol; hexavalent alcohols such as sorbitol and mannitol; polyvalent alcohol polymers such as diethylene glycol, dipropylene glycol, triethylene glycol, polypropylene glycol, tetraethylene glycol, diglycerin, polyethylene glycol, triglycerin, tetraglycerin, polyglycerin, and polyethylene glycol monomethyl ether; divalent alcohol alkyl ethers such as ethylene glycol monomethyl ether, ethylene glycol monoethyl ether, ethylene glycol monobutyl ether, ethylene glycol monophenyl ether, ethylene glycol monohexyl ether, ethylene glycol mono-2-methylhexyl ether, ethylene glycol isoamyl ether, ethylene glycol benzyl ether, and ethylene glycol isopropyl ether; divalent alcohol alkyl ethers such as diethylene glycol monomethyl ether, diethylene glycol monoethyl ether, diethylene glycol monobutyl ether, diethylene glycol butyl ether, triethylene glycol monomethyl ether, triethylene glycol monoethyl ether, propylene glycol monomethyl ether, propylene glycol monoethyl ether, propylene glycol monobutyl ether, propylene glycol isopropyl ether, dipropylene glycol methyl ether, dipropylene glycol ethyl ether, and dipropylene glycol butyl ether; glycerin monoalkyl ethers such as xyl alcohol, selachyl alcohol, and batyl alcohol; sugar alcohols such as sorbitol, maltitol, maltotriose, mannitol, sucrose, erythritol, glucose, fructose, starch degraded sugar, maltose, xylitol, and starch degraded sugar reduced alcohol; and polyvalent alcohols such as glyceride, tetrahydrofurfuryl alcohol, POE-tetrahydrofurfuryl alcohol, POP-butyl ether, POP•POE-butyl ether, tripolyoxypropylene glycerin ether, POP-glycerin ether, POP-glycerin ether phosphate, and POP•POE-pentanerythritol ether. Among the above-described alcohol solvents, diethylene glycol monobutyl ether, 1,3-butanediol, dipropylene glycol monomethyl ether, and polyethylene glycol monomethyl ether are preferable, and polyethylene glycol monomethyl ether is particularly preferable. Each of these alcohol components may be used alone or in combination with the others. In the case of using two or more of them in combination, the ratio and type of the combination can be appropriately selected depending on the purpose.

The alcohol solvent preferably accounts for 60% by mass or more, more preferably 65% by mass or more, much more preferably 80% by mass or more, and particularly preferably 90% by mass or more, of the ink. When the alcohol solvent accounts for 60% by mass or more of the ink, the proportion of components in the ink that can be solidified in the process of solidifying the liquid contained in the decorative board base paper (to be described later) is increased. Thus, in the process of producing a decorative board by applying heat and pressure (to be described later), generation of air bubbles that is caused by vaporization of the liquid which has not been solidified can be suppressed. As a result, deterioration of adhesiveness in the decorative board is suppressed. Accordingly, all of the organic solvent components contained in the ink may be alcohol solvents.

The alcohol solvent preferably has a boiling point of 250° C. or higher, more preferably 280° C. or higher, and much more preferably 290° C. or higher. By including an alcohol solvent having a boiling point of 250° C. or higher in the ink, even after the ink is discharged from nozzles of an inkjet head for a long time, the nozzles are suppressed from being rapidly dried and thereby clogged, thus achieving good discharge stability and image quality. In addition, by using an alcohol solvent having a boiling point of 250° C. or higher, generation of bubbles due to vaporization can be suppressed in the process of producing a decorative board by applying heat and pressure (to be described later). As a result, deterioration of adhesiveness in the decorative board can be suppressed.

More preferably, an alcohol solvent having a boiling point of 250° C. or higher accounts for 60% by mass or more of the ink.

Further, the alcohol solvent contained in the ink preferably has a viscosity of 40 mPa·s or less, more preferably 15 mPa·s or less, at room temperature (25° C.). When the viscosity is 15 mPa·s or less, the viscosity of the compounded ink falls within the viscosity band suitable for discharging with an inkjet head, thereby achieving good discharge stability and image quality.

The content of the organic solvent in the ink is not particularly limited and may be appropriately selected depending on the purpose, but is preferably in a range of from 10% to 95% by mass, and more preferably from 20% to 95% by mass.

Water

The content of water in the ink is not particularly limited and may be appropriately selected according to the purpose, and can be in a range of from 0% to 90% by mass. The content of water in the ink is preferably in a range of from 0% to 40% by mass, more preferably from 0% to 30% by mass, further preferably from 0% to 25% by mass. By including a small amount of water in the ink, the content of the alcohol solvent in the ink is increased. Therefore, even after the ink is discharged from nozzles of an inkjet head for a long time, the nozzles are suppressed from being rapidly dried and thereby clogged, thus achieving good discharge stability and image quality. In addition, by including a small amount of water, the amount of liquid which is not solidified in the process of solidifying a liquid contained in the decorative board base paper (to be described later) can be decreased. Thus, in the process of producing a decorative board by applying heat and pressure (to be described later), generation of air bubbles that is caused by vaporization of the water which has not been solidified can be suppressed. As a result, deterioration of adhesiveness of the decorative board is suppressed. Therefore, the content of water is preferably in the above-described range, but water may not be contained in the ink.

Additives

The ink may further contain a surfactant, a defoamer, a preservative, a fungicide, a corrosion inhibitor, and/or a pH adjuster.

Process of Solidifying Liquid Contained in Decorative Board Base Paper

The method for manufacturing a printing paper for decorative boards according to an embodiment of the present invention includes a process of solidifying a liquid contained in the decorative board base paper having the print layer. The "liquid contained in the decorative board base paper" refers to liquid components retained in the decorative board base paper, such as liquid components contained in the resin-containing liquid applied to the decorative board base paper and liquid components contained in the ink applied to the decorative board base paper at the time of forming the print layer. Further, "solidification of the liquid contained in the decorative board base paper" refers to chemical or physical solidification of the liquid in the decorative board base paper caused by at least one of the resin and the resin precursor applied to the decorative board base paper. Specifically, the solidification includes, for example, formation of a covalent bond caused by a reaction of an organic solvent which is a liquid component of the ink applied to the decorative board base paper with at least one of the resin and the resin precursor applied to the decorative board base paper, and gelation caused by incorporating the liquid contained in the decorative board base paper into a cross-linked structure formed a cross-linkage of at least one of the resin and the resin precursor applied to the decorative board base paper.

The method of solidifying the liquid contained in the decorative board base paper is appropriately selected and may be, for example, a method of promoting of the above-described "reaction" or "cross-linkage". Specific examples of such a method include, but are not limited to, a method of heating the decorative board base paper by a heater, a method of irradiating the decorative board base paper with ultraviolet rays by an ultraviolet ray irradiator, a method of irradiating the decorative board base paper with an electron beam by an electron beam irradiator. Among these methods, a method of heating by a heater is preferable. This is because the method of heating by a heater requires no additional step in a conventional production process and the productivity is not impaired. In addition, the method of heating by a heater is capable of vaporizing and removing a liquid contained in the decorative board base paper which is not able to solidify or difficult to solidify, thus improving adhesiveness of the decorative board. Examples of the heater include, but are not limited to, known devices such as a heat blower heating with warm air, an infrared dryer using an infrared lamp, a heated roll passing over a drying target, and an induction heater utilizing induction heating.

As the liquid contained in the decorative board base paper is solidified as described above, the amount of liquid present at the interface between the decorative board base paper and a member that can come into contact with the decorative board base paper, such as a substrate and an overlay (to described later), is reduced, suppressing deterioration of adhesiveness in the decorative board. In the process of solidifying the liquid contained in the decorative board base paper by the above-described "cross-linkage", the colorant contained in the ink applied to the decorative board base paper is incorporated at the same time. As a result, the position of the colorant in the decorative board base paper is fixed, and the resulting decorative board printing paper and decorative board each have a print layer having a high image density. Further, when the liquid contained in the decorative board base paper is solidified by the above-described "reaction", the liquid is solidified by forming a covalent bond with at least one of the resin and the resin precursor applied to the decorative board base paper. Thus, generation of bubbles due to vaporization can be suppressed in the process of producing a decorative board by applying heat and pressure to be described later. As a result, deterioration of adhesiveness in the decorative board can be suppressed.

Method for Manufacturing Laminated Structure such as Decorative Board

A method for manufacturing a laminated structure, such as a decorative board, according to an embodiment of the present invention includes a process of applying heat and pressure to a laminate in which a print medium, such as the decorative board printing paper prepared by the above-described manufacturing method, and a substrate, optionally along with an overlay or the like, are laminated. A method of applying heat and pressure is preferably conducted by applying a pressure of from 10 to 180 kg/cm$^2$ for 3 to 60 minutes at a temperature of from 70° C. to 220° C. with a heating-pressurizing assembly such as a hot press. By conducting the process of applying heat and pressure, a laminated structure such as a decorative board in which layers are bonded and integrated to each other can be obtained. A core paper impregnated with a conventionally-used phenolic resin may be molded between the layers of the print medium (e.g., decorative board printing paper), substrate, and overlay. Since the laminated structure provides excellent image density, interlayer adhesiveness, and production efficiency, it is preferably used for building materials. Hereinafter, a method for manufacturing a decorative board is described as an example.

Substrate

The substrate imparts functions such as mechanical strength and handleability to the decorative board. Preferred examples of the substrate include, but are not limited to, general materials mainly composed of wood. Specific examples thereof include, but are not limited to, veneers made of various materials such as cedar, Japanese cypress, Japanese zelkova, pine, lauan, teak, and melapi, wood veneer, wood plywood, particleboard, medium-density fiberboard (MDF), and oriented strand board (OSD). Among these materials, particleboard and MDF are preferred for excellent mechanical strength, price, and availability. The substrate is not limited to materials mainly composed of wood as long as it is able to impart the above function.

Overlay

The overlay is a protective layer that imparts mechanical strength, heat resistance, chemical resistance, or the like to the surface of the decorative board to improve durability of the print layer of the decorative board printing paper prepared by the above manufacturing method. Examples of the overlay include, but are not limited to, a transparent paper that contains little or no ash and is impregnated with a resin such as melamine resin. Examples of the paper include, but are not limited to, paper made from wood pulp fiber with a large amount of α-cellulose components, cotton linter fiber paper, and a polyester film.

Apparatus for Manufacturing Print Medium such as Decorative Board Printing Paper An apparatus for manufacturing a print medium, such as a printing paper for decorative boards, according to an embodiment of the present invention includes: an applying device configured to apply a resin-containing liquid comprising at least one of a resin and a resin precursor to a base paper for decorative boards; a printing device configured to form a print layer on or in the base paper to which the resin-containing liquid is applied; and a solidifying device configured to solidify a liquid contained in the base paper having the print layer, and no dryer is disposed on a conveyance path between the applying device and the printing device. In the present disclosure, the manufacturing apparatus refers not only to a case where all of the plurality of units constituting the manufacturing apparatus are disposed in a single apparatus, but also to a case where each unit is disposed independently or in a straddling manner in two or more apparatuses. Preferably, the applying device for applying the resin-containing liquid to a medium such as decorative laminate base paper and the printing device are disposed in single equipment and continuously disposed on the conveyance path for the medium. As such devices are disposed in single equipment, the process of forming a print medium such as decorative board printing paper can be continuously conducted, thus shortening the time for forming a printing medium such as decorative board printing paper and saving the space required for forming a print medium such as decorative board printing paper. In addition, since the process of applying the resin-containing liquid to the medium such as decorative board base paper and the process of forming a print layer are continuously conducted, it is easy to conduct the next process of forming a print layer while the medium such as decorative board base paper to which the resin-containing liquid is applied is kept in a wet state. Hereinafter, an apparatus for manufacturing a decorative board printing paper is described as an example.

A schematic view of an apparatus for manufacturing a decorative board printing paper according to an embodiment of the present invention is illustrated in the attached drawings. Referring to the drawings, a manufacturing apparatus 1 for manufacturing a decorative board printing paper includes a decorative board base paper feeder 10, conveyance rollers 11, a resin-containing liquid immersion tank 12, liquid discharge heads 13, and a heater 14.

The decorative board base paper feeder 10 rotationally drives to feed a decorative board base paper in a conveyance direction indicated by an arrow A. The decorative board base paper feeder 10 conveys decorative board base paper either by driving itself or by rotating following other driving unit.

The conveyance rollers 11 rotationally drive to convey the decorative board base paper fed to the manufacturing apparatus 1 along a conveyance path 100 provided in the manufacturing apparatus 1. Each of the conveyance rollers 11 conveys decorative board base paper either by driving itself or by rotating following other driving unit.

The resin-containing liquid immersion tank 12 holds a resin-containing liquid 110 therein. The conveyance path 100 passes through the resin-containing liquid immersion tank 12 for immersing the decorative board base paper in the resin-containing liquid 110. Thus, the resin-containing liquid 110 is applied to the decorative board base paper.

The liquid discharge heads 13 each have a plurality of nozzle arrays in each of which a plurality of nozzles is arranged. The liquid discharge heads 13 are each disposed such that the liquid is discharged from the nozzles in a direction facing the conveyance path 100 for the decorative board base paper. The liquid discharge heads 13 discharge respective inks that are liquids of magenta (M), cyan (C), black (K), yellow (Y), or the like, in order on the decorative board base paper to form a print layer.

The liquid discharge heads 13 may discharge the liquids by a pressure generated by a pressure generator. Examples of a liquid discharger disposed in the liquid discharge heads 13 include, but are not limited to, a piezoelectric actuator (which may use a laminated piezoelectric element), a thermal actuator using an electrothermal transducer such as a heating resistor, and an electrostatic actuator comprising a vibration plate and a counter electrode.

The manufacturing apparatus 1 for manufacturing a decorative board printing paper includes no device for drying the decorative board base paper on a part of the conveyance path 100 between the resin-containing liquid immersion tank 12 and the liquid discharge heads 13.

The heater 14 heats the decorative board base paper on or in which the print layer is formed. As a result, a liquid contained in the decorative board base paper is solidified in the decorative board base paper.

The manufacturing apparatus 1 ejects a resulting decorative board printing paper produced by being heated by the heater 14. The manufacturing apparatus 1 may further include a heating-pressurizing device for applying heat and pressure to a laminate in which the ejected decorative board printing paper and a substrate are laminated.

EXAMPLES

Further understanding of the present disclosure can be obtained by reference to certain specific examples provided herein below for the purpose of illustration only and are not intended to be limiting.

KSH-801P (having a basis weight of 80 g/m$^2$ and an ash content 32 g %, manufactured by KJ SPECIALTY PAPER Co., Ltd.) was used as the decorative board base paper.

Production Examples of Resin-Containing Liquid

Preparation of Resin-Containing Liquid 1

A polyvinyl alcohol resin (POVAL JP-03 manufactured by Japan Vam & Poval Co., Ltd.) was mixed with water so that the solid content concentration became 15% by mass to prepare a resin-containing liquid 1.

Preparation of Resin-Containing Liquid 2

A water-soluble melamine (methylol melamine, NIKARESIN S-176 manufactured by Nippon Carbide Industries Co., Inc.) was mixed with water so that the solid content concentration became 20% by mass, thus prepare a resin-containing liquid 2.

Preparation of Resin-Containing Liquid 3

A water-soluble resol phenol resin (IG-1002 manufactured by DIC Corporation) and a water-soluble melamine (methylol melamine, NIKARESIN S-176 manufactured by Nippon Carbide Industries Co., Inc.) in a molar ratio of 5:4 were mixed with water so that the solid content concentration became 25% by mass, to prepare a resin-containing liquid 3.

Production Examples of Ink

Preparation of Ink 1

The below-listed materials were premixed. The resulting mixture was subject to a circulation dispersion treatment for 7 hours using a disk type bead mill (KDL type available from Shinmaru Enterprises Corporation, filled with zirconia ball media having a diameter of 0.3 mm) and thereafter filtered with a 0.2-μm polypropylene filter. Thus, an ink 1 was prepared.

REGAL 400R (carbon black pigment manufactured by Cabot Corporation): 6.0% by mass PIONIN A-51-B (anionic surfactant manufactured by Takemoto Oil & Fat Co., Ltd.): 0.8% by mass ZONYL FS-300 (surfactant manufactured by E.I. du Pont de Nemours and Company): 2.0% by mass Diethylene glycol monobutyl ether (having a boiling point of 230° C.): 5.0% by mass 1,3-Butanediol (having a boiling point of 203° C.): 23.0% by mass Ion-exchange water: 63.2% by mass Preparation of Tnks 2 to 5

Inks 2 to 5 were prepared in the same manner as in the Preparation of Ink 1, except that the compositions and contents (% by mass) were changed according to Table 1.

TABLE 1

| | | Ink | | | | |
|---|---|---|---|---|---|---|
| | | 1 | 2 | 3 | 4 | 5 |
| | Carbon Black Pigment | 6.0 | 6.0 | 6.0 | 6.0 | 6.0 |
| Surfactant | PIONIN A-51-B | 0.8 | 0.8 | 0.3 | 0.3 | |
| | ZONYL FS-300 | 2.0 | 2.0 | 2.0 | 2.0 | |
| Pigment Dispersant | SOLSPERSE 39000 | | | 2.4 | 2.4 | 2.4 |
| Organic Solvent | Polyethylene glycol monomethyl ether (b.p. 290° C.-310° C.) | | 55.0 | 65.0 | | 91.6 |
| | Diethylene glycol monobutyl ether (b.p. 230° C.) | 5.0 | | | | |
| | 1,3-Butanediol (b.p. 203° C.) | 23.0 | | | | |
| | Dipropylene glycol monomethyl ether (b.p. 188° C.) | | | | 65.0 | |
| | Ion-exchange Water | 63.2 | 36.2 | 24.3 | 24.3 | |
| | Total | 100.0 | 100.0 | 100.0 | 100.0 | 100.0 |

The product names and manufacturers of the materials described in Table 1 are listed below.

REGAL 400R (carbon black pigment manufactured by Cabot Corporation)

PIONIN A-51-B (anionic surfactant manufactured by Takemoto Oil & Fat Co., Ltd.)

ZONYL FS-300 (surfactant manufactured by E. I. du Pont de Nemours and Company)

SOLSPERSE 39000 (pigment dispersant manufactured by The Lubrizol Corporation)

Polyethylene glycol monomethyl ether (HIMOL PM, having a viscosity of 13 mPa·s and a boiling point of from 290° C. to 310° C.)

Diethylene glycol monobutyl ether (having a boiling point of 230° C.)

1,3-Butanediol (having a boiling point of 203° C.)

Dipropylene glycol monomethyl ether (HISOLV DPM, having a viscosity of 4.1 mPa·s and a boiling point of 188° C.)

Production Example of Decorative Board Printing Paper and Decorative Board

Example 1

The decorative board base paper was subjected to the following Treatment 1 using the ink 1 and the resin-containing liquid 1 to prepare a decorative board printing paper 1. As a device for forming a print layer, ONE PASS JET (manufactured by Tritek Co., Ltd.) equipped with MH5420 (an inkjet head manufactured by Ricoh Co., Ltd.) was used to form a solid image at 600 dpi and a printing speed of 75 m/min. At the time of forming the print layer, the internal temperature of the head and the ink supply unit were adjusted so that the viscosity of the ink was in the range of from 10 to 12 mPa·s.

Treatment 1 i) Immerse the decorative sheet base paper in the resin-containing liquid and visually confirm that the resin-containing liquid sufficiently penetrated the decorative board base paper.

ii) Form a print layer immediately thereafter without drying the decorative board base paper.

iii) After formation of the print layer, dry the decorative board base paper with hot air (110° C., 2 minutes) to obtain a decorative board printing paper.

Treatment 1 was conducted such that the time between the end of the process of immersing the decorative board base paper in the resin-containing liquid and the start of forming the print layer was 30 minutes or less and the rate of mass change X of the resin-containing liquid represented by the above formula (1) was 0.7 or more.

Next, an MDF laminated wood having a thickness of 15 mm, the above-obtained decorative board printing paper, and an overlay base paper (OL-25 manufactured by Ota Industry Co., Ltd.) were laminated in this order. The laminate was inserted into a hot press to be heated at a temperature of 180° C. and pressed with a pressure of 30 kg/cm$^2$ for a pressing time of 60 seconds to obtain a decorative board 1.

Examples 2 to 15 and Comparative Examples 1 to 8

Decorative board printing papers and decorative boards of Examples 2 to 15 and Comparative Examples 1 to 8 were each prepared in the same manner as in Example 1 except that the ink, the resin-containing liquid, and the treatment were changed according to Table 2. Details of the treatment 2 and the treatment 3 are described below.

Treatment 2 i) Form a print layer on a decorative board base paper.

ii) Dry the decorative board base paper thereafter with hot air (110° C., 2 minutes).

iii) Immerse the decorative sheet base paper in the resin-containing liquid thereafter and visually confirm that the resin-containing liquid sufficiently penetrated the decorative board base paper.

iv) After the immersion, dry the decorative board base paper with hot air (110° C., 2 minutes) again to obtain a decorative board printing paper.

Treatment 3 i) Immerse the decorative sheet base paper in the resin-containing liquid and visually confirm that the resin-containing liquid sufficiently penetrated the decorative board base paper.

ii) Dry the decorative board base paper thereafter with hot air (110° C., 2 minutes).

iii) After the drying, form a print layer.

iv) Dry the decorative board base paper with hot air (110° C., 2 minutes) again to obtain a decorative board printing paper.

The obtained decorative boards of Examples 1 to 15 and Comparative Examples 1 to 8 were evaluated in image density and adhesiveness according to the following methods and evaluation criteria.

Evaluation of Image Density

The image density in the solid image area of the obtained decorative board was measured using a reflective-type color spectrophotometric densitometer (manufactured by X-Rite). The ranks A and B are considered to be practical. The evaluation results are presented in Table 2.

Evaluation Criteria

A: Image density is 1.6 or greater.

B: Image density is 1.4 or greater and less than 1.6.

C: Image density is 1.1 or greater and less than 1.4.

D: Image density is less than 1.1.

Evaluation of Adhesiveness

The obtained decorative boards were evaluated in terms of adhesiveness by the cross-cut adhesion test according to HS (Japanese Industrial Standards) K5400 (old standard). In the following evaluation criteria, an adhesiveness of 100 refers to a state in which no peeling occurred all over the cross-cut area having 100 lattices. An adhesiveness of 70 refers to a state in which no peeling occurred in 70% of the cross-cut area. The ranks A, B, and C are considered to be practical. The evaluation results are presented in Table 2.

Evaluation Criteria

A: Adhesiveness is 100.

B: Adhesiveness is 95 or greater and less than 100.

C: Adhesiveness is 70 or greater and less than 95.

D: Adhesiveness is less than 70.

In addition, inkjet discharge stability was evaluated based on the occurrence of white streaks according to the following methods and evaluation criteria.

Evaluation of Inkjet Discharge Stability (Occurrence of White Streak)

ONE PASS JET (manufactured by Tritek Co., Ltd.) equipped with MH5420 (an inkjet head manufactured by Ricoh Co., Ltd.) was filled with an ink and caused to discharge the ink for 30 minutes at 28 kHz with an image chart having a print area of 60% as an input signal. Next, a decorative board printing paper and a decorative board were prepared in the same manner as in Examples 1 to 15 and Comparative Examples 1 to 8 except that printing of a solid image in Treatments 1 to 3 were changed to printing of an image having a print area of 60%, and the state of white streaks (non-printed portions) was visually evaluated. The ranks A, B, and C are preferable. The evaluation results are presented in Table 2.

Evaluation Criteria

A: White streaks (non-printed portions) are not observed at all.

B: Several white streaks (non-printed portions) are observed.

C: Obvious white streaks (non-printed portions) are observed.

D: Non-printed portion is not streaky but spreads out in a plane.

TABLE 2

| | | Ink | Resin-containing Liquid | Treatment | Mass Change Rate X | Image Density | Adhesiveness | Discharge Stability |
|---|---|---|---|---|---|---|---|---|
| Examples | 1 | 1 | 1 | 1 | 0.74 | B | C | C |
| | 2 | 1 | 2 | 1 | 0.76 | A | B | C |
| | 3 | 1 | 3 | 1 | 0.78 | A | B | C |
| | 4 | 2 | 1 | 1 | 0.83 | B | C | B |
| | 5 | 2 | 2 | 1 | 0.86 | B | B | B |
| | 6 | 2 | 3 | 1 | 0.77 | A | B | B |
| | 7 | 3 | 1 | 1 | 0.76 | B | C | A |
| | 8 | 3 | 2 | 1 | 0.8 | A | A | A |
| | 9 | 3 | 3 | 1 | 0.89 | A | A | A |
| | 10 | 4 | 1 | 1 | 0.72 | B | C | A |
| | 11 | 4 | 2 | 1 | 0.79 | A | B | A |
| | 12 | 4 | 3 | 1 | 0.86 | A | B | A |
| | 13 | 5 | 1 | 1 | 0.79 | A | C | A |
| | 14 | 5 | 2 | 1 | 0.92 | A | A | A |
| | 15 | 5 | 3 | 1 | 0.86 | A | A | A |
| Comparative Examples | 1 | 1 | 2 | 2 | 0.55 | D | B | D |
| | 2 | 1 | 2 | 3 | 0.58 | D | C | D |
| | 3 | 2 | 2 | 2 | 0.6 | D | B | C |
| | 4 | 2 | 2 | 3 | 0.67 | C | C | C |
| | 5 | 3 | 2 | 2 | 0.64 | D | C | B |
| | 6 | 3 | 2 | 3 | 0.52 | C | D | B |
| | 7 | 5 | 2 | 2 | 0.53 | D | C | B |
| | 8 | 5 | 2 | 3 | 0.64 | C | D | B |

It is confirmed that the decorative boards of Examples 1 to 15 provide good image density and adhesiveness because a print layer is formed before the decorative board base paper applied with the resin-containing liquid is dried. In addition, Treatment 1 in Examples 1 to 15 has less processes and excellent production efficiency than Treatment 2 or 3 in Comparative Examples 1 to 8. It is also confirmed that, when the ink contains an alcohol solvent, discharge stability required in inkjet can be improved and both image density and adhesiveness required for decorative boards are achieved. On the other hand, it is confirmed that, in each of Comparative Examples 1 to 8, image density is insufficient, and adhesiveness and/or discharge stability may be insufficient.

The reason why the evaluation results in Examples are excellent is that, because the ink is applied to the decorative board base paper that has been subjected to neither the process of drying the decorative board base paper applied with the resin-containing liquid nor the process of solidifying the liquid contained in the decorative board base paper, dot spreading is so good that image density is improved and generation of streaks are hardly perceived by visual observation. It is also presumed that adhesiveness between layers of the decorative board formed by application of heat and pressure is improved by the process of solidifying the liquid contained in the decorative board base paper such as the heating process.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A method for manufacturing a printing paper for decorative boards, the method comprising:

applying a resin-containing liquid comprising at least one of a resin and a resin precursor to a base paper for decorative boards;

forming a print layer on or in the base paper which is not dried after the resin-containing liquid is applied thereto; and solidifying a liquid contained in the base paper having the print layer, wherein the forming comprises applying, to the base paper, an ink comprising a solvent having a functional group capable of reacting with the at least one of the resin and the resin precursor to form a covalent bond, and wherein the solidifying comprises reacting the solvent with the at least one of the resin and the resin precursor, thereby forming a covalent bond between the solvent and the at least one of the resin and the resin precursor.

2. The method of claim 1, wherein the solidifying comprises crosslinking the at least one of the resin and the resin precursor contained in the resin-containing liquid.

3. The method of claim 1, wherein the resin comprises an amino resin.

4. The method of claim 1, wherein the forming comprises discharging the ink by an inkjet method.

5. The method of claim 1, wherein the solvent is an alcohol solvent, and the alcohol solvent accounts for 60% by mass or more of the ink.

6. The method of claim 5, wherein the alcohol solvent is not triethylene glycol.

7. The method of claim 5, wherein the alcohol solvent is polyethylene glycol monomethyl ether.

8. The method of claim 5, wherein the alcohol solvent has a boiling point of 250° C. or higher.

9. A method for manufacturing a decorative board, the method comprising:

applying heat and pressure to a laminate of a printing paper manufactured by the method of claim 1 and a substrate.

10. The method of claim 1, wherein the solidifying comprises heating the base paper by a heater, irradiating the base paper with ultraviolet rays by an ultraviolet ray irradiator, irradiating the base paper with an electron beam by an electron beam irradiator, or any combination thereof.

11. The method of claim 1, wherein the ink has a water content of from 0% to 40% by mass.

12. A method for manufacturing a laminated structure, the method comprising:

applying a resin-containing liquid comprising at least one of a resin and a resin precursor to a medium;

forming a print layer on or in the medium which is not dried after the resin-containing liquid is applied thereto;

solidifying a liquid contained in the medium having the print layer to form a print medium; and applying heat and pressure to a laminate in which the print medium and a substrate are laminated, wherein the foil ling comprises applying, to the base paper, an ink comprising a solvent having a functional group capable of reacting with the at least one of the resin and the resin precursor to form a covalent bond, and wherein the solidifying comprises reacting the solvent with the at least one of the resin and the resin precursor, thereby forming a covalent bond between the solvent and the at least one of the resin and the resin precursor.

* * * * *